United States Patent [19]

Mayer

[11] Patent Number: 4,553,827

[45] Date of Patent: Nov. 19, 1985

[54] ELECTROPHOTOGRAPHIC COPYING APPARATUS INCLUDING AN ENLARGED IMAGE DEVELOPING STATION

[75] Inventor: Edward F. Mayer, San Jose, Calif.

[73] Assignee: Ricoh Company, Ltd., Tokyo, Japan

[21] Appl. No.: 510,073

[22] Filed: Jun. 30, 1983

[51] Int. Cl.[4] ..... G03G 15/08

[52] U.S. Cl. ..... 355/3 DD; 355/14 D; 118/651; 118/655

[58] Field of Search ..... 355/3 DD, 14 D, 3 R, 355/14 R; 118/658, 647, 651, 655

[56] References Cited

U.S. PATENT DOCUMENTS

| | | | |
|---|---|---|---|
| 3,537,427 | 11/1970 | Sato | 118/224 X |
| 3,557,751 | 1/1971 | Kushima et al. | 118/637 |
| 3,631,838 | 1/1972 | Kushima et al. | 118/637 |
| 3,638,614 | 2/1972 | Young et al. | 118/637 |
| 4,068,623 | 1/1978 | O'Toole et al. | 118/658 |
| 4,100,611 | 7/1978 | Jugle | 366/139 |
| 4,113,371 | 9/1978 | Fraser et al. | 355/4 |
| 4,116,555 | 9/1978 | Young et al. | 355/15 |
| 4,149,487 | 4/1979 | Kulbida et al. | 355/3 DD X |

*Primary Examiner*—A. C. Prescott

*Attorney, Agent, or Firm*—Flehr, Hohbach, Test, Albritton & Herbert

[57] ABSTRACT

An assembly for developing a latent electrostatic image formed on the photosensitive outer surface of a rotating developing drum making up a part of an electrophotographic copying apparatus is disclosed herein. This assembly includes a supply of developer contained within a housing adjacent the drum, a primary magnetic brush within the housing for continuously moving fresh developer in close proximity with the drums photosensitive outer surface, and an arrangement including a series of rollers acting on the developer leaving the primary brush for enhancing the developing process.

6 Claims, 3 Drawing Figures

ELECTROPHOTOGRAPHIC COPYING APPARATUS INCLUDING AN ENLARGED IMAGE DEVELOPING STATION

The present invention relates generally to electrophotographic copying apparatus and more particularly to a specifically designed assembly for developing a latent electrostatic image formed on the outer surface of a developing drum making up part of the overall apparatus.

A known type of electrophotographic apparatus includes a rotatable drum having a photosensitive outer circumferential surface and means for rotating the drum in a controlled fashion so that its outer circumferential surface defines a fixed annular path of movement. This apparatus produces copies from a given master by first forming a given electrostatic latent image corresponding to the particular information to be copied on the photosensitive outer circumferential surface of the drum. Thereafter, the latent image formed is developed by means of a toner which is applied to the image bearing surface in a particular way. Finally, the applied toner is transferred from the drum to a blank sheet for transforming the latter to the desired copy.

Of particular relevance to the present invention is the developing station used in the known electrophotographic apparatus described above. The station includes a reservoir of developer and a number of components including developing rollers which act on the developer in order to bring the latter in contact with the drum's photosensitive outer surface. While these components are generally satisfactory for their intended purposes, the overall developing area within the developing station, i.e., the area of contact between the developer and the drum's photo sensitive outer surface, is limited by the developing rollers which are relatively large and therefore this area is relatively small.

In view of the foregoing, it is an object of the present invention to provide a developing station comprised of an assembly of components which cooperate to extend the developing area in an uncomplicated and economical way. As will be described in more detail hereinafter, this is accomplished by means of a housing which contains a supply of developer (i.e., a carrier and toner), a primary magnetic brush (or roller) corresponding to one of the developing rollers in the above-recited known apparatus, and an arrangement including a series of adjacent, relatively small rollers. The housing is disposed in close proximity to an outer surface segment of the developing drum as the latter moves through its path of rotation. At the same time, the brush is mounted within the housing for rotation about its own axis in confronting relationship with the drum in a way which continuously moves fresh developer within the housing means closer to and in the direction of movement of the drum's outer surface. The small rollers serve to intercept the flow of developer, as the latter is moved by and away from the primary brush, and act on the intercepted developer in order to bring it in closer contact with the developing drum. In accordance with one embodiment of the present invention, the small rollers include roughened outer surfaces and/or they contain means for producing magnetic fields for mechanically and/or magnetically agitating the developer. In another embodiment, the small rollers cooperate with a guide plate for directing the developer between the rollers and the guide plate and, thereafter, the toner (forming part of the developer) is directed around and between the rollers and ultimately in contact with the developing drum. These embodiments will be described in more detail hereinafter in conjunction with the drawing, wherein:

Figure 1:
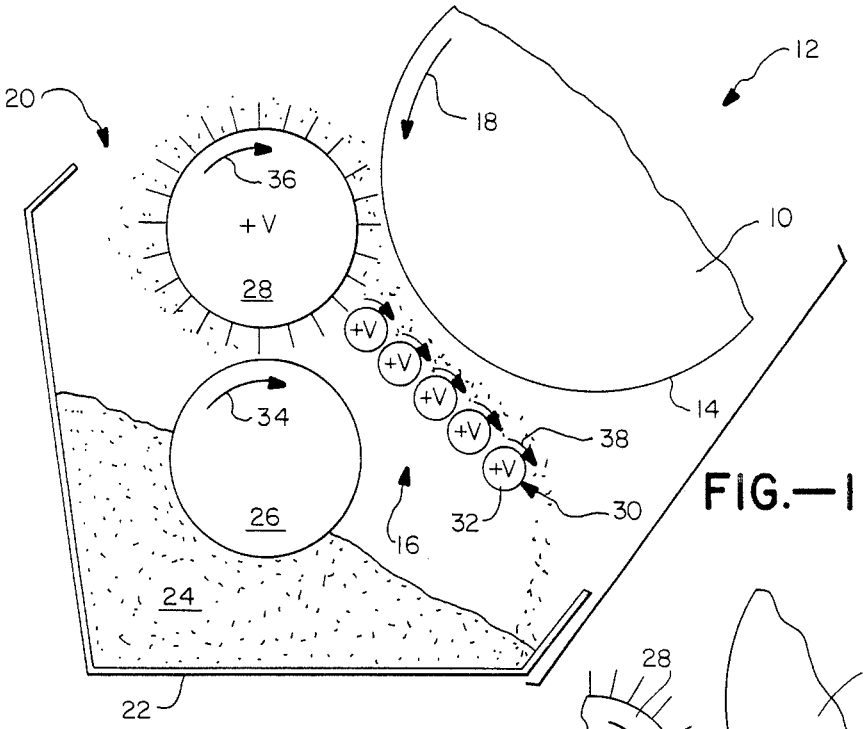
FIG. 1 is a diagrammatic illustration of an assembly designed in accordance with one embodiment of the present invention to develop a latent electrostatic image formed on the photosensitive outer surface of a rotating developing drum making up part of an electrophotographic copying apparatus.

Turning first to FIG. 1, a rotatable developing drum 10, forming part of an overall electrophotographic copying apparatus generally indicated by the reference numeral 12, is illustrated. The drum includes a photosensitive outer circumferential surface 14 and means (not shown) for rotating the drum in a controllable manner so as to cause surface 14 to move along a fixed annular path through a charging station, an exposure station, a developing station, a transfer or copy forming station and, finally, a drum cleaning station. Only the developing station which is generally indicated at 16 is illustrated. In actual operation, drum 10 is caused to rotate in the direction of arrow 18, for moving surface 14 first through the charging station where the surface is electrically charged to a suitable level and, thereafter, through an exposure station in order to form an electrostatic latent image conforming to the original being copied. The electrostatic latent image thus formed is then moved through developing station 16 which, as will be described below, includes an overall assembly 20 for developing the image with toner particles. Thereafter, the developed image moves through the transfer station for actually making the ultimate copy. Finally, the drum surface moves through the cleaning station where any residual toner is removed therefrom.

In order to more fully appreciate the present invention, attention is directed to the specific way in which toner particles are used to develop a latent electrostatic image formed on the developing drum. Specifically, the toner particles which are capable of holding an electric charge are initially carried on metal (magnetizable) carrier particles, although a one-component developer system could be used. In the case where toner and carrier particles are combined to form what may be referred to as the developer, the toner particles carry one electric charge (polarity) and the carriers the opposite charge (polarity). For purposes of simplicity, and as a frame of reference (without limiting the claimed invention), it will be assumed that the toner particles are negatively charged and the carriers are positively charged, although the polarity could just as well be reversed. Based on this frame of reference, the latent image on drum 10 is positively charged to various levels between a maximum level and a minimum level while the nonimage areas are positively charged to a lesser minimum level. Overall assembly 20 is responsible for causing the toner particles to separate from their carriers while, at the same time, placing these particles in sufficiently close proximity to the surface 14 of drum 10, such that the image areas (and only the image areas) will attract and retain these particles.

As will be seen hereinafter, assembly 20 provides a relatively large area of contact between these particles and the drum surface in order to ensure that the latent image is developed.

Figure 2:
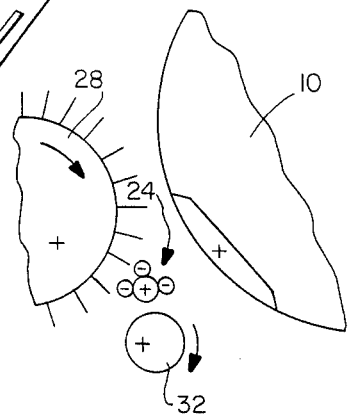
FIG. 2 is an enlarged aspect of the assembly illustrated in FIG. 1.

As illustrated in FIG. 1, overall assembly 20 includes a housing diagrammatically indicated at 22 which contains a supply of developer 24, in close proximity to an outer surface segment of drum 10, as the latter moves through its path of rotation. In the particular embodiment shown, the developer is comprised of the previously described negatively charged toner particles and the positively charged carriers, as best illustrated in FIG. 2. The assembly is also shown including an elevator roller 26 and a developing roller 28 or a primary brush as it may also be called. These latter two components may be identical to corresponding ones recited above. In addition, the assembly may include the other components forming part of the assembly described in that application, including a second developing roller. However, because of the relatively large size of each of these developing rollers, the effective developing area per roller is relatively small as compared to the amount of space required for the rollers. However, in accordance with the present invention, overall assembly 20 includes an arrangement generally indicated at 30 for extending this area without adding appreciably to the space required for the overall assembly. As will be seen, one is accomplished by providing a number of smaller rollers so as to actually increase the roller surface area in close proximity to the drum.

In view of the above, arrangement 30 includes a series of rollers 32 which are substantially smaller in diameter than developing roller 28. These smaller "secondary" rollers are successively disposed within housing 22 in the position shown in FIG. 1. In actual operation, elevator roller 26 is rotated in the direction of arrow 24 in order to elevate fresh developer 24 into contact with developing roller (or brush) 28. The latter rotates in the direction of arrow 36 in confronting relationship with surface 14 of drum 10 for continuously moving the fresh developer closer to and in the direction of movement of the drum surface. The rollers 32 are successively disposed in the path of movement of the flowing developer as the latter is moved from roller 28. At the same time, these secondary rollers are themselves rotated by suitable means (not shown) in the direction of arrows 38. In this way, the secondary rollers intercept and thereby agitate the flowing developer, causing the latter to move into closer contact with the drum's outer surface along the entire length of the series of rollers. In order to ensure that the non-image areas of the surface 14 do not receive toner particles, both the primary developing roller 28 and the secondary rollers 32 are biased with positive voltage at a level below the minimum positive charge in the image areas but above the positive charge in the nonimage areas.

In order to enhance the turbulent interaction between secondary rollers 32 and the developer leaving primary roller 28, the outer surfaces of the secondary rollers are preferably roughened. In addition, or in lieu thereof, each secondary roller may contain magnetic pole pieces for producing a magnetic field which acts on the developer for imparting turbulence thereto. In this regard, the secondary rollers should be rotated sufficiently fast so as not to capture and retain the carrier particles to any appreciable extent.

Figure 3:
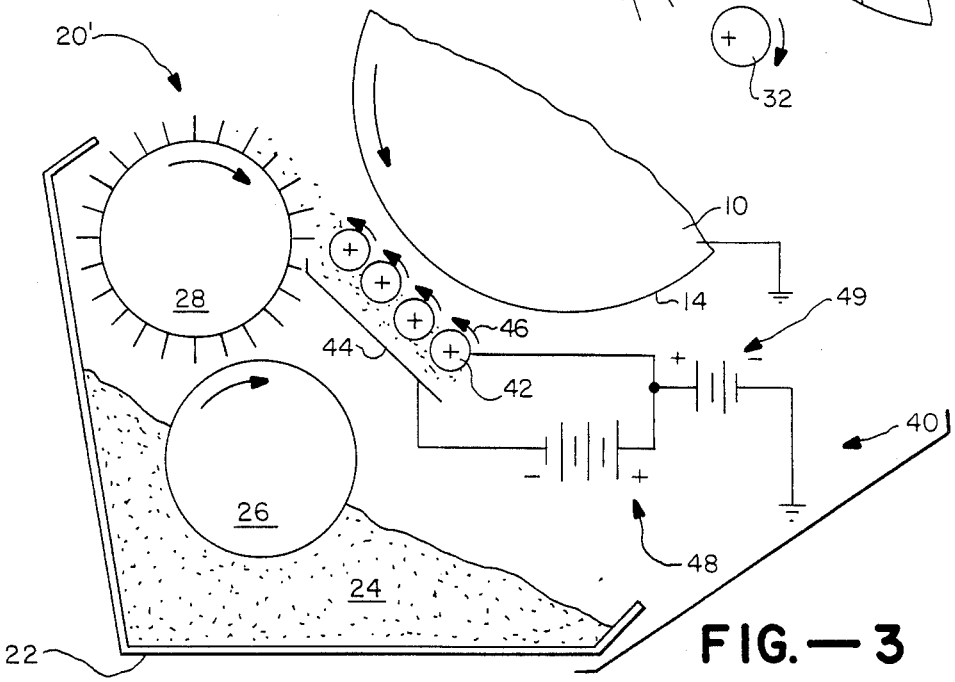
FIG. 3 is a developing assembly designed in accordance with a second embodiment of the present invention.

Referring to FIG. 3, attention is directed to a modified developing assembly 20' which is shown cooperating with the same drum 10. In addition, assembly 20' may include the same housing 22 containing fresh developer 24, and elevator roll 26 and a primary developing roll 28. However, assembly 20 does not include an agitating arrangement 30 but, rather, a developer intercepting arrangement 40. As illustrated in FIG. 3, arrangement 40 includes a series of smaller secondary rollers 42 which are located in generally the same location as rollers 32, i.e., in confronting relationship with a segment of the drum surface 14. Arrangement 40 also includes an electrically conductive guide plate 44 which is located in confronting relationship with the series of rollers 42, on the opposite side of drum surface 14, and spaced a relatively short distance therefrom. The secondary rollers are caused to rotate by suitable means not shown in the direction of arrows 46. In this regard, it should be noted that the axes of the secondary rollers are parallel with the axis of drum 10, and that both the drum and the secondary rollers rotate in the same direction such that their confronting surfaces move in opposite directions. It should also be noted that because of this relative rotational movement and because the rollers 42 are positioned relatively close to drum surface 14, it is difficult, if not impossible, for the larger developer moving away from primary drum 28 to initially enter between the secondary rollers and the rotating drum. Rather, the developer is caused to move between the secondary rollers and guide plate 44. At the same time, a voltage source generally indicated at 48 is used to bias all of the rollers with positive voltage, with respect to the guide plate. Although connection is shown to only one roller all are connected to the voltage source. Source 49 biases the rollers positively with respect to ground and applies the proper bias between the rollers and the photoconductor electrode. In this way, the toner forming part of the developer is caused to separate from its carrier particles and move between and onto the secondary rollers and, thereafter, in sufficiently close proximity to the drum to develop the latent image thereon. Rollers 42 would be biased to whatever voltage level as necessary to cause the negative toner particles to develop the positive latent usage on drum 10 while not developing the non-image areas of the drum. Thus, the voltage level to which rollers 42 are subjected is less then the voltage level of the latent image areas on the drum but greater than the level of the non-image areas.

What is claimed:

1. An assembly for developing a latent electrostatic image formed on the photosensitive outer surface of a rotating developing drum making up part of an electrophotographic copying apparatus, said assembly comprising:

(a) means for housing a supply of developer including negatively charged toner particles in close proximity to an outer surface segment of said drum as the latter moves through its path of rotation;

(b) means including a primary magnetic developing roller mounted within said housing means for rotating about its own axis in confronting relationship with said outer surface segment of said drum in a way which continuously moves fresh developer within the housing means closer to and in the direction of movement of said surface segment; and (c) an arrangement for agitating the flow of said developer by means of mechanical agitation only without using a magnetic field as the developer is moved by and away from said primary brush, said arrangement including (i) a series of adjacent rollers smaller in cross-section than said preliminary roller, successively disposed within said housing means in the path of movement of said developer as the latter moves away from said primary roller.

(ii) means for rotating said secondary rollers whereby to impart a tumbling action to the developer intercepted thereby, and (iii) means for electrically biasing said rollers with a positive voltage.

2. An assembly according to claim 1 wherein the outer circumferential surface of each of said rollers is roughened whereby to enhance agitation of said developer as the latter is intercepted by the rollers.

3. An assembly according to claim 1 wherein said agitating arrangement includes a developer guide plate spaced from and in confronting relationship with said series of rollers, opposite said drum segment, and means for electrically biasing said plate with a negative voltage and wherein said rollers are caused to rotate in a way which cooperates with said drum and guide plate to move the developer leaving said primary brush particles between the rollers and plate and then to cause the toner forming part of the developer to move around and between the rollers into closer proximity with said drum.

4. An assembly for developing a latent electrostatic image formed on the photosensitive outer surface of a rotating developing drum making up a part of an electrophotographic copying apparatus, said assembly containing:

(a) means for housing a supply of developer in close proximity to an outer surface segment of said drum as the latter moves through its path of rotation;

(b) means including a primary magnetic brush mounted within said housing means for rotating about its own axis in confronting relationship with said outer surface segment of said drum in a way which continuously moves fresh developer within the housing means closer to and in the direction of movement of said surface segment; and (c) an arrangement for mechanically intercepting the flow of said developer as the latter is moved by and away from said primary brush without using a magnetic field, said arrangement including a series of adjacent rollers successively disposed within said housing means, in the path of movement of said developer, as the latter moves away from said brush and means for causing said developer leaving said primary brush to move adjacent the sides of said rollers opposite said drum and, thereafter, for causing at least the toner particles forming part of said developer to move around and between adjacent rollers into closer proximity with said drum.

5. An assembly according to claim 4 wherein said arrangement includes a developer guide plate spaced from and in confronting relationship with said series of rollers, opposite said drum surface segment, means for electrically biasing each of said rollers with positive voltage and said guide plate with negative voltage, and means for rotating said rollers in a way which causes them to cooperate with said drum and said guide plate to move the developer between the rollers and plate and then to move the toner particles around and between the rollers into closer proximity with said drum.

6. An assembly according to claim 5 wherein the axis of rotation of each of said rollers is parallel with the axis of rotation of said developing drum and wherein all of the rollers and said drum rotate in the same clockwise or counterclockwise direction.

* * * * *